US009039350B2

(12) United States Patent
Winn

(10) Patent No.: US 9,039,350 B2
(45) Date of Patent: May 26, 2015

(54) IMPINGEMENT COOLING SYSTEM FOR USE WITH CONTOURED SURFACES

(75) Inventor: Aaron Gregory Winn, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 632 days.

(21) Appl. No.: 13/345,779

(22) Filed: Jan. 9, 2012

(65) Prior Publication Data

US 2013/0177396 A1 Jul. 11, 2013

(51) Int. Cl.
*F01D 5/18* (2006.01)
*F01D 25/08* (2006.01)

(52) U.S. Cl.
CPC ..... *F01D 5/186* (2013.01); *F01D 5/187* (2013.01); *F01D 25/08* (2013.01)

(58) Field of Classification Search
CPC ..... F01D 9/23; F01D 25/12; F05D 2260/201
USPC ..... 415/115, 116
See application file for complete search history.

(56) References Cited

U.S. PATENT DOCUMENTS

| | | | | |
|---|---|---|---|---|
| 3,950,114 | A * | 4/1976 | Helms | 416/97 A |
| 4,187,054 | A | 2/1980 | Landis, Jr. et al. | |
| 4,712,979 | A * | 12/1987 | Finger | 416/96 R |
| 4,719,748 | A * | 1/1988 | Davis et al. | 60/39.37 |
| 5,197,852 | A | 3/1993 | Walker et al. | |
| 5,609,466 | A | 3/1997 | North et al. | |
| 6,227,798 | B1 | 5/2001 | Demers et al. | |
| 6,354,795 | B1 * | 3/2002 | White et al. | 415/116 |
| 6,382,906 | B1 | 5/2002 | Brassfield et al. | |
| 6,383,602 | B1 | 5/2002 | Fric et al. | |
| 6,386,825 | B1 | 5/2002 | Burdgick | |
| 6,402,464 | B1 * | 6/2002 | Chiu et al. | 415/116 |
| 6,418,618 | B1 | 7/2002 | Burdgick | |
| 6,439,846 | B1 * | 8/2002 | Anderson et al. | 416/96 R |
| 6,761,529 | B2 | 7/2004 | Soechting et al. | |
| 6,769,865 | B2 | 8/2004 | Kress et al. | |
| 6,932,568 | B2 | 8/2005 | Powis et al. | |
| 6,984,101 | B2 | 1/2006 | Schiavo, Jr. | |
| 7,029,228 | B2 | 4/2006 | Chan et al. | |
| 7,104,751 | B2 * | 9/2006 | Naik et al. | 415/116 |
| 7,147,432 | B2 * | 12/2006 | Lowe et al. | 415/116 |
| 7,252,481 | B2 | 8/2007 | Stone | |
| RE40,658 | E | 3/2009 | Powis et al. | |
| 8,714,909 | B2 * | 5/2014 | Propheter-Hinckley | 415/115 |
| 2002/0028134 | A1 | 3/2002 | Burdgick | |
| 2002/0062945 | A1 * | 5/2002 | Hocker et al. | 165/53 |
| 2002/0182057 | A1 | 12/2002 | Liotta et al. | |
| 2002/0187040 | A1 | 12/2002 | Predmore | |
| 2005/0244267 | A1 | 11/2005 | Coign et al. | |
| 2006/0053798 | A1 | 3/2006 | Hadder | |
| 2006/0062673 | A1 | 3/2006 | Coign et al. | |
| 2006/0073011 | A1 | 4/2006 | Lee et al. | |
| 2007/0237624 | A1 | 10/2007 | Nigmatulin | |
| 2008/0089780 | A1 | 4/2008 | Erickson et al. | |

(Continued)

*Primary Examiner* — Dwayne J White
*Assistant Examiner* — William Grigos
(74) *Attorney, Agent, or Firm* — Sutherland Asbill & Brennan LLP

(57) ABSTRACT

The present application provides an impingement cooling system for use with a contoured surface. The impingement cooling system may include an impingement plenum and an impingement plate with a linear shape facing the contoured surface. The impingement surface may include a number of projected area thereon with a number of impingement holes having varying sizes and varying spacings.

20 Claims, 3 Drawing Sheets

(56) References Cited

U.S. PATENT DOCUMENTS

| | | | | |
|---|---|---|---|---|
| 2008/0152488 | A1 | 6/2008 | Kammel et al. | |
| 2009/0074562 | A1* | 3/2009 | Self et al. | 415/115 |
| 2009/0249791 | A1* | 10/2009 | Belsom | 60/755 |
| 2010/0011773 | A1 | 1/2010 | Suleiman et al. | |
| 2010/0068034 | A1* | 3/2010 | Schiavo et al. | 415/115 |
| 2010/0068041 | A1 | 3/2010 | Nigmatulin et al. | |
| 2010/0080708 | A1* | 4/2010 | Gupta et al. | 416/223 A |
| 2010/0278631 | A1 | 11/2010 | Heda et al. | |
| 2010/0281879 | A1 | 11/2010 | Shapiro et al. | |
| 2010/0284800 | A1 | 11/2010 | Sewall et al. | |
| 2010/0310367 | A1* | 12/2010 | Devore et al. | 416/1 |
| 2011/0014045 | A1 | 1/2011 | McCall | |
| 2011/0014054 | A1 | 1/2011 | Nagler et al. | |
| 2011/0044803 | A1 | 2/2011 | DiPaola et al. | |
| 2012/0020768 | A1* | 1/2012 | Krueckels et al. | 415/1 |
| 2012/0082550 | A1* | 4/2012 | Harris et al. | 416/95 |

* cited by examiner

IMPINGEMENT COOLING SYSTEM FOR USE WITH CONTOURED SURFACES

TECHNICAL FIELD

The present application and the resultant patent relate generally to gas turbine engines and more particularly relate to an impingement cooling system for uniformly cooling contoured surfaces in a gas turbine and elsewhere in a simplified design.

BACKGROUND OF THE INVENTION

Impingement cooling systems have been used with turbine machinery to cool various types of components such as casings, buckets, nozzles, and the like. Impingement cooling systems cool the turbine components via an airflow so as to maintain adequate clearances between the components and to promote adequate component lifetime. One issue with known impingement cooling systems is the ability to maintain a uniform heat transfer coefficient across non-uniform or contoured surfaces. Maintaining constant heat transfer coefficients generally requires that the overall shape of the impingement plate follows the contours of the surface to be cooled. Producing a contoured impingement plate, however, may be costly and may result in uneven cooling flows therein.

There is therefore a desire for an improved impingement cooling system. Such an improved impingement cooling system may provide constant heat transfer coefficients over a contoured surface in a simplified and low cost configuration while maintaining adequate cooling efficiency.

SUMMARY OF THE INVENTION

The present application and the resultant patent thus provide an impingement cooling system for use with a contoured surface. The impingement cooling system may include an impingement plenum and an impingement plate with a linear shape facing the contoured surface. The impingement plate may include a number of projected areas thereon with a number of impingement holes having varying sizes and varying spacings.

The present application and the resultant patent further provide a turbine. The turbine may include a turbine nozzle, an impingement cooling system with a number of impingement holes with a number of sizes and spacings, and a turbine component with a contoured surface positioned about the impingement cooling system.

The present application and the resultant patent further provide a turbine. The turbine may include a turbine nozzle, an impingement cooling system with a linear shape and having a number of impingement holes with a number of sizes and spacings, and a turbine component with a contoured surface positioned about the impingement cooling system such that the impingement cooling system maintains the contoured surface with substantially constant heat transfer coefficients thereacross.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
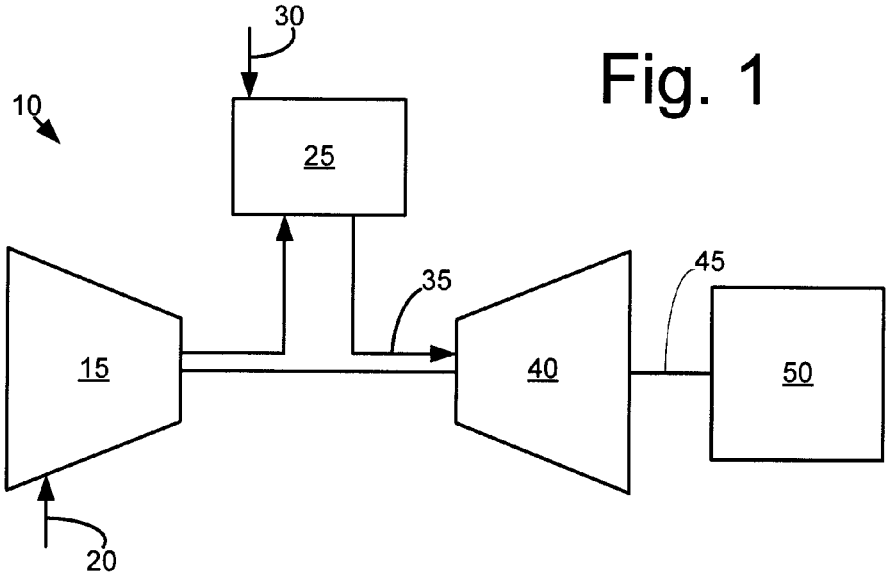
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
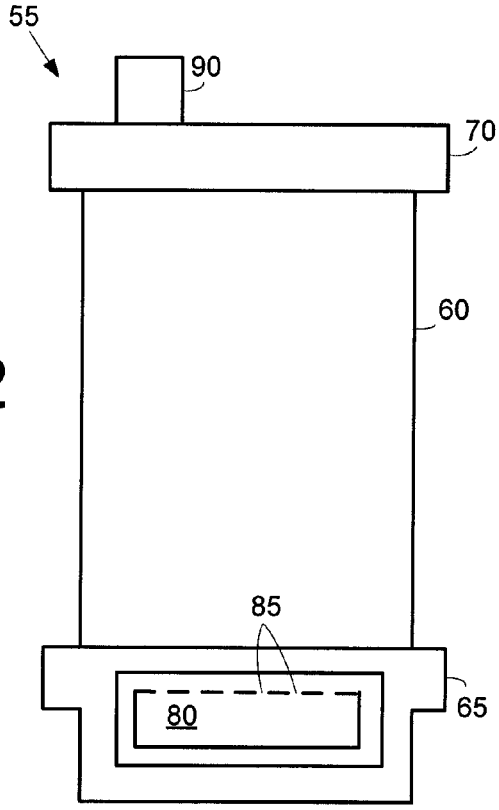
FIG. 2 is a partial side view of a nozzle vane with an impingement cooling system therein.

FIG. 2 is an example of a nozzle 55 that may be used with the turbine 40 described above. Generally described, the nozzle 55 may include a nozzle vane 60 that extends between an inner platform 65 and an outer platform 70. A number of the nozzles 55 may be combined into a circumferential array to form a stage with a number of rotor blades (not shown). The nozzle 55 also may include an impingement cooling system in the form of an impingement plenum 80. The impingement plenum 80 may have a number of impingement apertures 85 formed therein. The impingement plenum 80 may be in communication with a flow of air 20 from the compressor 15 or another source via a cooling conduit 90. The flow of air 20 flows through the nozzle vane 60, into the impingement plenum 80, and out via the impingement apertures 85 so as to impingement cool a portion of the nozzle 55 or elsewhere. Other types of impingement plenums 80 are known.

Many other types of impingement cooling systems are known. These known impingement cooling systems, however, generally are uniformly sized and shaped as described above. Alternatively, the impingement plate may be contoured so as to follow the contours of the surface to be cooled so as to maintain constant heat transfer coefficients across the surface.

Figure 3:
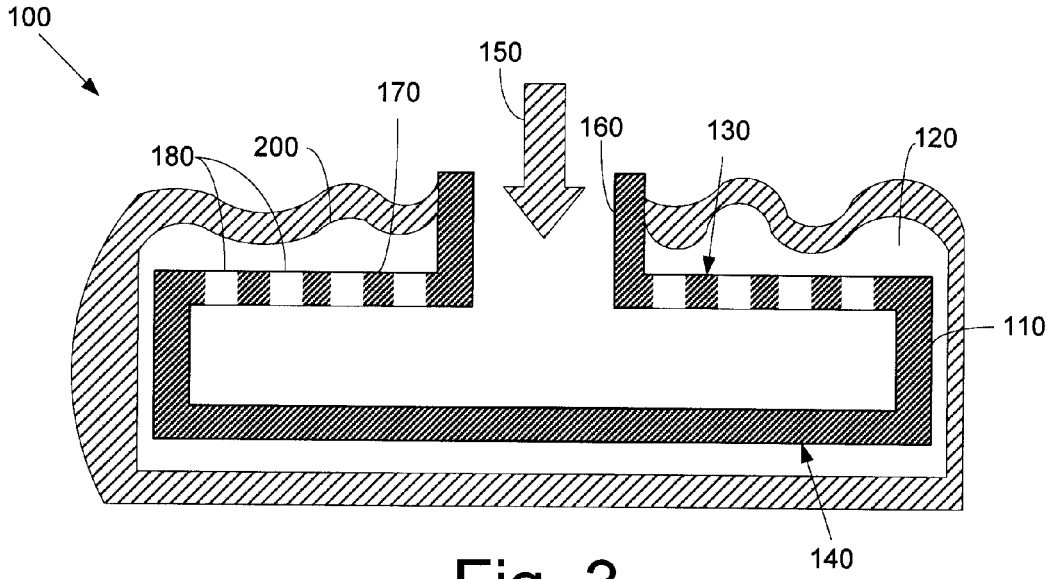
FIG. 3 is a partial side view of a nozzle vane with an impingement cooling system as may be described herein.
Figure 4:
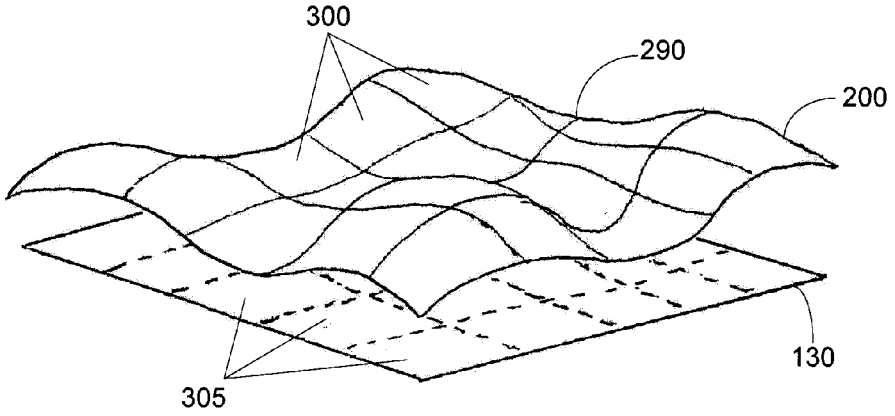
FIG. 4 is a perspective view of an impingement grid overlaid on the contoured surface of FIG. 3.
Figure 5:
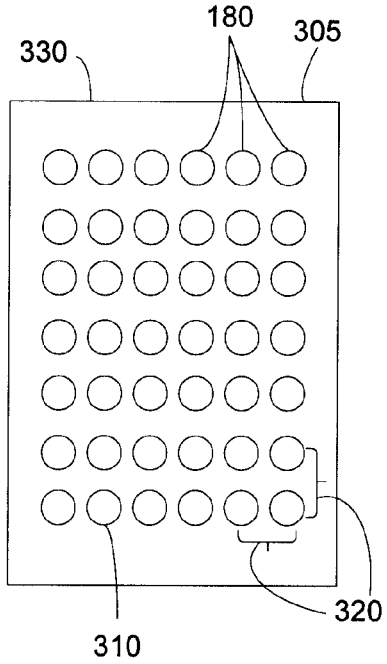
FIG. 5 is a plan view of a portion of the impingement cooling plate of FIG. 3.
Figure 6:
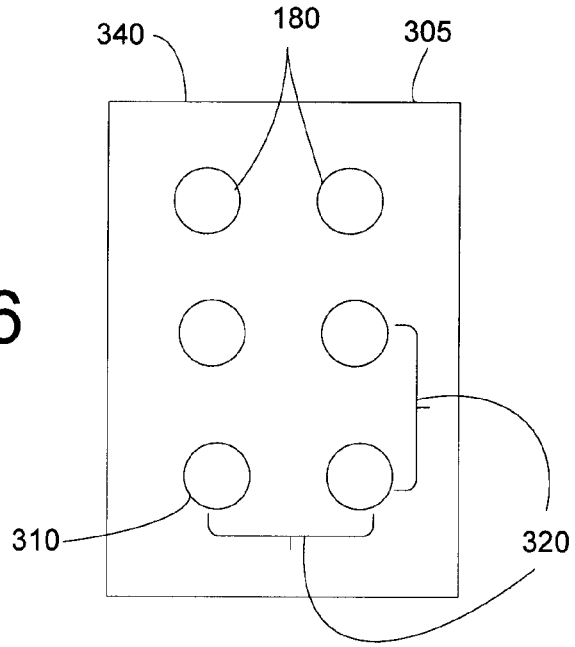
FIG. 6 is a plan view of a portion of the impingement cooling plate of FIG. 3.

FIG. 3 and FIG. 4 show an example of an impingement cooling system 100 as may be described herein. The impingement cooling system 100 may include an impingement plenum 110. The impingement plenum 110 may include a cavity 120 defined by an impingement plate 130 and a cover plate 140. The impingement plenum 110 may be in communication with a cooling flow 150 via a cooling conduit 160. The cooling conduit 160 may be in communication with the compressor 15 or other source of the cooling flow 150.

The impingement plate 130 of the impingement plenum 110 may have a substantially flat or linear surface 170. The impingement plate 130 also may have a number of impingement holes 180 therein. The size, shape, configuration and location of the impingement holes 180 may vary as will be described in more detail below. Other components and other configurations may be used herein.

The impingement cooling system 100 may be used with any type of turbine component or any component requiring cooling. In this example, the impingement cooling system 100 may be used with an undulating or a contoured surface 200. The contoured surface 200 may have any desired shape or configuration. In this example, the contoured surface 200 may include a number of contoured areas of varying distances from the impingement cooling system 100.

In order to maintain a constant heat transfer coefficient across the contoured surface 200, the spacing of the holes 180 in the impingement plate 130 of the impingement plenum 110 may be adjusted to compensate for the undulation in the contoured surface 200 in a discretized manner. The contoured surface 200 may be divided into a grid 290 with a number of contoured areas 300 therein. Each of the contoured areas 300 may be projected onto an associated projected area 305 on the impingement plate 130. Each of the projected areas 305 of the impingement plate 130 may have a number of the impingement holes 180 therein of differing size, shape, and configuration based upon the offset of the opposed areas 300 from the projected areas 305. The group of impingement holes 180 in each of the projected areas 305 thus may have a size 310 and a spacing 320, both of which may be adjusted uniformly over that local projected area 305 to maintain an average heat transfer coefficient over that discretized area 300 within the contoured surface 200. The impingement holes 180 thus each may have the variable size 310 and the variable spacing 320 or a sub-set thereof, with both the size 310 and the spacing 320 being held constant over a given projected area 305. For example, a first area 330 may have a number of closely spaced small holes 180 while a second area 340 may have a number of widely spaced large holes 180. Any number of sizes and positions may be used herein in any number of the projected areas 305 depending upon the distance to the opposed surface.

The impingement cooling system 100 thus uses the impingement plenum 110 to provide adequate cooling with a simplified impingement plate design so as to lower costs and increase production. Specifically, the impingement holes 180 may vary with respect to a ratio of the hole diameter to the thickness of the impingement plate 130, the ratio of the channel height to hole diameter, and the orthogonal spacing of the hole array. Effectiveness may be considered in the context of z/d requirements where d is the hole diameters and z is the average distance from a projected area 305 to a contoured area 300 and/or x/d where x is measured along the length of the impingement plate 130. Within each projected area 305 of the grid 290, the size of impingement holes 180 may be adjusted to maintain relative z/d requirements. Within the same area 305, hole positioning or x/d also may be adjusted to maintain effectiveness. As such, the impingement plate 130 of the impingement plenum 110 may maintain consistent heat transfer coefficients with the use of the linear surface 170 as opposed to a contoured surface.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. An impingement cooling system for use with a non-planar contoured surface of gas turbine with multiple irregular depressions and projections, comprising:

a nozzle with an impingement plenum in communication with a cooling flow in a cooling conduit, the cooling flow flowing through the impingement plenum in a first direction;

an impingement plate facing the contoured surface;

the impingement plate comprising a substantially flat shape;

a cover plate positioned substantially parallel to the impingement plate, wherein the impingement plenum comprises a cavity defined between the impingement plate and the cover plate, such that the cooling flow impacts the cover plate and flows through the impingement plate in a second direction;

the impingement plate comprising a plurality of projected areas thereon, the projected areas corresponding to the multiple irregular depression and projections of the contoured surface;

wherein each of the plurality of projected areas comprises a plurality of impingement holes with varying sizes and varying spacings between the impingement holes for each of the plurality of projected areas.

2. The impingement cooling system of claim 1, wherein the plurality of projected areas comprises a first area with impingement holes of a first size and a second area with impingement holes of a second size.

3. The impingement cooling system of claim 1, wherein the plurality of projected areas comprises a first area with impingement holes of a first spacing and a second area with impingement holes of a second spacing.

4. The impingement cooling system of claim 1, wherein the plurality of projected areas comprises a first area with impingement holes of a first size and a first spacing and a second area with impingement holes of a second size and a second spacing.

5. The impingement cooling system of claim 1, wherein the multiple projections of the contoured surface comprises a plurality of projections with tips positioned at a plurality of distances from the impingement plate.

6. The impingement cooling system of claim 5, wherein the size and the spacing of the plurality of impingement holes in each of the plurality of projected areas varies with the distance to an opposed contoured area.

7. The impingement cooling system of claim 1, wherein the impingement plate maintains the contoured surface with substantially constant heat transfer coefficients thereacross.

8. A turbine, comprising:

a turbine nozzle;

an impingement cooling system;

the impingement cooling system comprising a plurality of impingement holes with a plurality of sizes and spacings between the plurality of impingement holes, and an impingement plenum with an impingement plate with the plurality of impingement holes therein; and a turbine component positioned about the impingement cooling system;

the turbine component comprising a contoured surface with multiple irregular depression and projections, wherein the plurality of impingement holes of the impingement cooling system correspond to the multiple irregular depressions and projections of the contoured surface.

9. The turbine of claim 8, wherein the impingement plate comprises a substantially flat shape.

10. The turbine of claim 8, wherein the impingement plate comprises a grid with a plurality of projected areas.

11. The turbine of claim 10, wherein the plurality of projected areas comprises the plurality of impingement holes therein.

12. The turbine of claim 10, wherein the plurality of projected areas comprises a first area with impingement holes of a first size and a second area with impingement holes of a second size.

13. The turbine of claim 10, wherein the plurality of projected area comprises a first area with impingement holes of a first spacing and a second area with impingement holes of a second spacing.

14. The turbine of claim 10, wherein the plurality of projected areas comprises a first area with impingement holes of a first size and a first spacing and a second area with impingement holes of a second size and a second spacing.

15. The turbine of claim 10, wherein the multiple projections of the contoured surface comprises a plurality of projections with tips positioned at a plurality of distances from the impingement plate.

16. The turbine of claim 8, wherein the impingement cooling system maintains the contoured surface with substantially constant heat transfer coefficients thereacross.

17. A turbine, comprising:

a turbine nozzle;

an impingement cooling system;

the impingement cooling system comprising a linear impingement plate with a plurality of impingement holes with a plurality of sizes and spacings between the plurality of impingement holes, and an impingement plenum with an impingement plate with the plurality of impingement holes therein; and a turbine component positioned about the impingement cooling system;

the turbine component comprising a contoured surface such that the impingement cooling system maintains the contoured surface with substantially constant heat transfer coefficients thereacross, wherein the contoured surface comprises multiple irregular depressions and projections, and the plurality of impingement holes of the impingement cooling system correspond to the multiple irregular depressions and projections of the contoured surface.

18. The impingement cooling system of claim 1, wherein the multiple depressions of the contoured surface comprises a plurality of depressions with troughs positioned at a plurality of distances from the impingement plate; and the plurality of impingement holes are positioned such that cooling flow flowing through the impingement holes impacts the contoured surface about the troughs.

19. The turbine of claim 8, wherein the multiple depressions of the contoured surface comprises a plurality of depressions with troughs positioned at a plurality of distances from the impingement plate; and the plurality of impingement holes are positioned such that cooling flow flowing through the impingement holes impacts the contoured surface about the troughs.

20. The turbine of claim 17, wherein the multiple depressions of the contoured surface comprises a plurality of depressions with troughs positioned at a plurality of distances from the impingement plate; and the plurality of impingement holes are positioned such that cooling flow flowing through the impingement holes impacts the contoured surface about the troughs.

* * * * *